US009725198B2

(12) United States Patent
Whang et al.

(10) Patent No.: US 9,725,198 B2
(45) Date of Patent: Aug. 8, 2017

(54) CUSTOMIZABLE SHRINK WRAP

(71) Applicant: Apple Inc., Cupertino, CA (US)

(72) Inventors: Eugene A. Whang, San Francisco, CA (US); Paul E. Newburn, San Jose, CA (US); Mark E. Doutt, San Jose, CA (US); Rafael L. Dionello, San Francisco, CA (US); Hsien Y. Pu, San Jose, CA (US); Michael A. Korinek, San Francisco, CA (US); Evan A. Cernokus, Campbell, CA (US); Michael S. Long, Fremont, CA (US)

(73) Assignee: APPLE INC., Cupertino, CA (US)

( * ) Notice: Subject to any disclaimer, the term of this patent is extended or adjusted under 35 U.S.C. 154(b) by 538 days.

(21) Appl. No.: 14/465,585

(22) Filed: Aug. 21, 2014

(65) Prior Publication Data

US 2015/0217891 A1 Aug. 6, 2015

Related U.S. Application Data

(60) Provisional application No. 61/934,621, filed on Jan. 31, 2014.

(51) Int. Cl.

| | |
|---|---|
| ***B65B 53/06*** | (2006.01) |
| ***B65B 61/18*** | (2006.01) |
| ***B65B 63/08*** | (2006.01) |
| ***B65D 75/00*** | (2006.01) |
| ***B65D 75/58*** | (2006.01) |

(52) U.S. Cl.
CPC ..... *B65B 53/063* (2013.01); *B65B 61/18* (2013.01); *B65B 63/08* (2013.01); *B65D 75/002* (2013.01); *B65D 75/5844* (2013.01)

(58) Field of Classification Search
CPC ..... B65B 53/063; B65B 63/08; B65B 61/18; B65B 53/06; B65D 75/002; B65D 75/5844
USPC ..... 53/440, 442, 127, 557, 509, 427; 156/309.9
See application file for complete search history.

(56) References Cited

U.S. PATENT DOCUMENTS

2005/0072698 A1* 4/2005 Kahl ..... B65D 75/002 206/320

* cited by examiner

*Primary Examiner* — Robert Long
*Assistant Examiner* — Xavier A Madison
(74) *Attorney, Agent, or Firm* — McDermott Will & Emery LLP

(57) ABSTRACT

Shrink wrap films that are customized to have a shape matching a shape of a particular part or parts are disclosed. The shrink wrap films can be formed using unique manufacturing techniques that involve heating the part or parts prior to applying the shrink wrap film. The resultant part or parts will have substantially wrinkle-free and defect-free shrink wrap film applied thereon. In some embodiments, additional functional and cosmetic features are formed in the shrink wrap film. In some embodiments, a laser cutting procedure is used to form the features in the shrink wrap film. Methods can be used to provide visually and tactilely smooth and aesthetically appealing shrink wrapped consumer products.

20 Claims, 10 Drawing Sheets

CUSTOMIZABLE SHRINK WRAP

CROSS-REFERENCE TO RELATED APPLICATIONS

This application claims priority to U.S. Provisional Application Ser. No. 61/934,621 filed Jan. 31, 2014 entitled "Customizable Shrink Wrap", which is incorporated herein by reference in its entirety.

FIELD

This disclosure relates generally to shrink wrap packaging and shrink wrapping methods. Methods described can be used to provide custom-fit shrink wraps that are wrinkle-free and cosmetically appealing.

BACKGROUND

Shrink wrap is widely used to provide plastic coverings for consumer products in order to secure the products or protect the products from scratches and damage during handling and shipping. Shrink wrap is generally a plastic film that shrinks when heated. The shrink wrap film is applied to a product by wrapping the product with the shrink wrap and then heating the shrink wrap causing the shrink wrap to shrink and envelope the product. In a production environment, the shrink wrap is typically heating by placing the shrink wrap and product in a convection oven. The hot air from the convection oven heats and shrinks the shrink wrap onto the product. It has been found, however, that conventional methods for applying shrink wrap onto larger products or products with edges, corner and curves can cause the shrink wrap to heat up unevenly resulting in a shrink wrapped product with wrinkles and other cosmetic defects. These defects may not be very important when shrink wrapping products such as water bottles or food items. However, for consumer products, such as electronic products, these cosmetic defects in the shrink wrap can detract from the aesthetic appeal of the final packaged product.

SUMMARY

This paper describes various embodiments that relate to shrink wraps and methods of shrink wrapping products.

According to one embodiment, a method of shrink wrapping a part is described. The method includes heating an external surface of the part. The external surface has a shape. The method also includes positioning a shrink wrap film while in an elongate state around the heated external surface. The method further includes shrinking the shrink wrap film over the external surface of the part. During the shrinking, the shrink wrap film contacts the heated external surface of the part causing the shrink wrap film to take on a contracted state having a shape that matches the shape of the external surface.

According to another embodiment, another method of shrink wrapping a part is described. The method includes heating an external surface of the part. The method also includes positioning a shrink wrap film around the external surface of the part such that an inner surface of the shrink wrap is proximate the heated external surface of the part. The method additionally includes heating an outer surface of the shrink wrap film such that the shrink wrap film shrinks and conforms to the external surface of the part. During the shrinking, the heated external surface of the part heats the inner surface of the shrink wrap causing uniform heating and shrinking of the shrink wrap film around the external surface of the part.

According to a further embodiment, a method of shrink wrapping an electronic device is described. The method includes heating an external surface of the electronic device. The method also includes positioning a shrink wrap film around the heated external surface of the electronic device. The method additionally includes shrinking the shrink wrap film by heating the shrink wrap film to a temperature sufficient for the shrink wrap film to conform to the external surface of the electronic device. Heating the external surface causes the shrink wrap to uniformly conform to the external surface of the electronic device.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
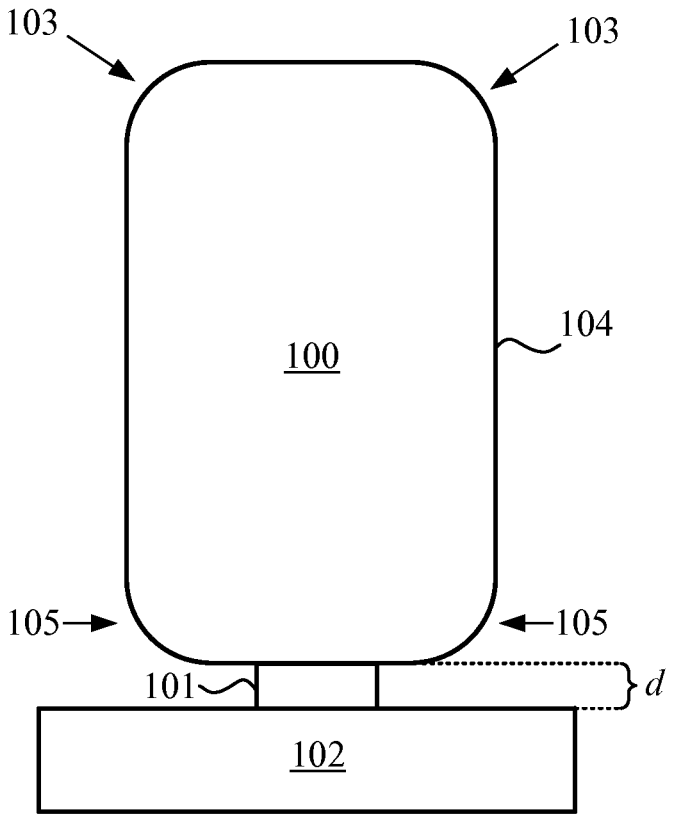
FIGS. 1A-1F show perspective views of a part undergoing a shrink wrapping process in accordance with some embodiments.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

The following disclosure relates to shrink wrap packaging. Disclosed herein are methods for shrink wrap packaging one or more parts within a shrink wrap film. In some embodiments, the shrink wrap can be formed around an electronic device. The electronic device may for example be a computing device or computer. In a particular embodiment, the shrink wrap can be formed in a tube and placed over the surfaces of parts to be shrink wrapped. The shrink wrap can be heated to cause the material of the shrink wrap tube to constrict (shrink) and form a tight fit around the electronic device. The shrink warp can form around three-dimensional surfaces of the part.

In particular embodiments, methods include forming a shrink wrap film that has a shape that conforms and matches a shape of the part without any wrinkles or other visible defects in the shrink wrap film. An external surface of the part can be heated to a predetermined temperature prior to applying the shrink wrap film. Heating the part prior to applying the shrink wrap can cause the shrink wrap film to conform better to the shape of the external surface of the part compared to using conventional shrink wrapping techniques. The resultant shrink wrapped part has a smooth and wrinkle-free surface that is visually and tactilely appealing, providing an enhanced consumer experience. In some embodiments, the part is an electronic device such as a computer, a portable electronic device or an electronic computer accessory, such as those manufactured by Apple Inc., based in Cupertino, Calif.

These and other embodiments are discussed below with reference to FIGS. 1-3. However, those skilled in the art will readily appreciate that the detailed description given herein with respect to these Figures is for explanatory purposes only and should not be construed as limiting.

Shrink wrap is generally a polymer film that contracts and shrinks when heated. Shrink wrap is typically used to provide a tightly affixed covering to a part or multiple parts without the use of adhesive. One of the conveniences of shrink wrapped consumer products is that the consumer can easily remove the shrink wrap. Conventional methods for shrink wrapping a part includes placing a shrink wrap on a part and heating the shrink wrap so that the shrink wrap contacts onto the part. Conventional techniques, however, can cause the shrink wrap to form wrinkles, bulges or bubbles, especially if the part is large and/or has curves, corners, edges or complex geometries. If the part is a consumer product, these visible and tactile defects can detract from the aesthetic look and feel of the product. Methods described herein can be used to provide custom-fit, visibly and tactilely smooth shrink wrapped films over one or more parts.

FIGS. 1A-1F show perspective views of part 100 undergoing a shrink wrapping process in accordance with some embodiments. FIG. lA show a side view of part 100 positioned on support 102. Part 100 has an exterior surface 104 that can have any suitable shape. In the embodiments shown in FIGS. 1A-1F, exterior surface 104 has a cylindrical shape that includes curved top portions 103 and curved bottom portions 105. In other embodiments, exterior surface 104 has a different three-dimensional shape, such as a rectangular prism, sphere, ovoid or irregular shape. Exterior surface 104 can include a combination of angled, curved and/or straight portions. Exterior surface 104 can correspond to a surface of any suitable material, such as metallic, plastic, ceramic or glass surfaces of part 100. In some embodiments, exterior surface corresponds to surfaces of multiple materials. That is, exterior surface 104 can include different portions made of different materials. Part 100 can be a consumer product that is fabricated in a manufacturing process. In one embodiment, part 100 includes a housing of an electronic device, such as a computer, or a portion of a computer or a computer assessor device. In some embodiments, the shrink wrapping process occurs after the electronic device is fully assembled with internal electronic components fully assembled within the housing. In other embodiments, the shrink wrapping process occurs at some earlier point in the fabrication of the electronic device where part 100 does not yet include all internal components.

In FIG. 1A, support 102 is configured to support part 100 during the shrink wrapping process. In some embodiments, support 102 includes puck 101 that elevates part 100 a distance d with respect to the top surface of support 102. Puck 101 can be an elevated portion of support 102 or a separate piece that can be coupled to support 102. Elevating part 100 provides access to more surface area of part 100 during a shrink wrapping process. In particular, puck 101 allows the shrink wrap to fit around curved bottom surface 105 of part 100. Distance d defines how far the shrink wrap film extends on the bottom surfaces of part 100. This will be demonstrated in detail below. Support 102 can be used to support part 100 on, for example, a conveyer belt that takes part 100 from station to station. In some embodiments, support 102 has an internal protrusion, post or other fastening mechanism to secure part 100 to support 102. In some embodiments, a vacuum chuck is positioned below part 100 to secure part 100 to support 102. In some embodiments, support 102 is designed to rotate part 100 during the shrink wrapping or other processes. Support 102 can be configured to support one or multiple parts. Note that any suitable method for supporting 100 can be used and is not limited to the embodiment shown in FIGS. 1A-1F. For example, rods (not shown) positioned on opposing end of part 100 can be used to support part 100. In some embodiments, the rods can rotate so as to rotate part 100 during the shrink wrapping or other processes. In some embodiments, external surface 104 is cleaned prior to subsequent processing in order to assure a proper cosmetic appearance of the shrink wrap. For example, external surface 104 can be cleaned of lubricant or other residues.

Figure 1B:
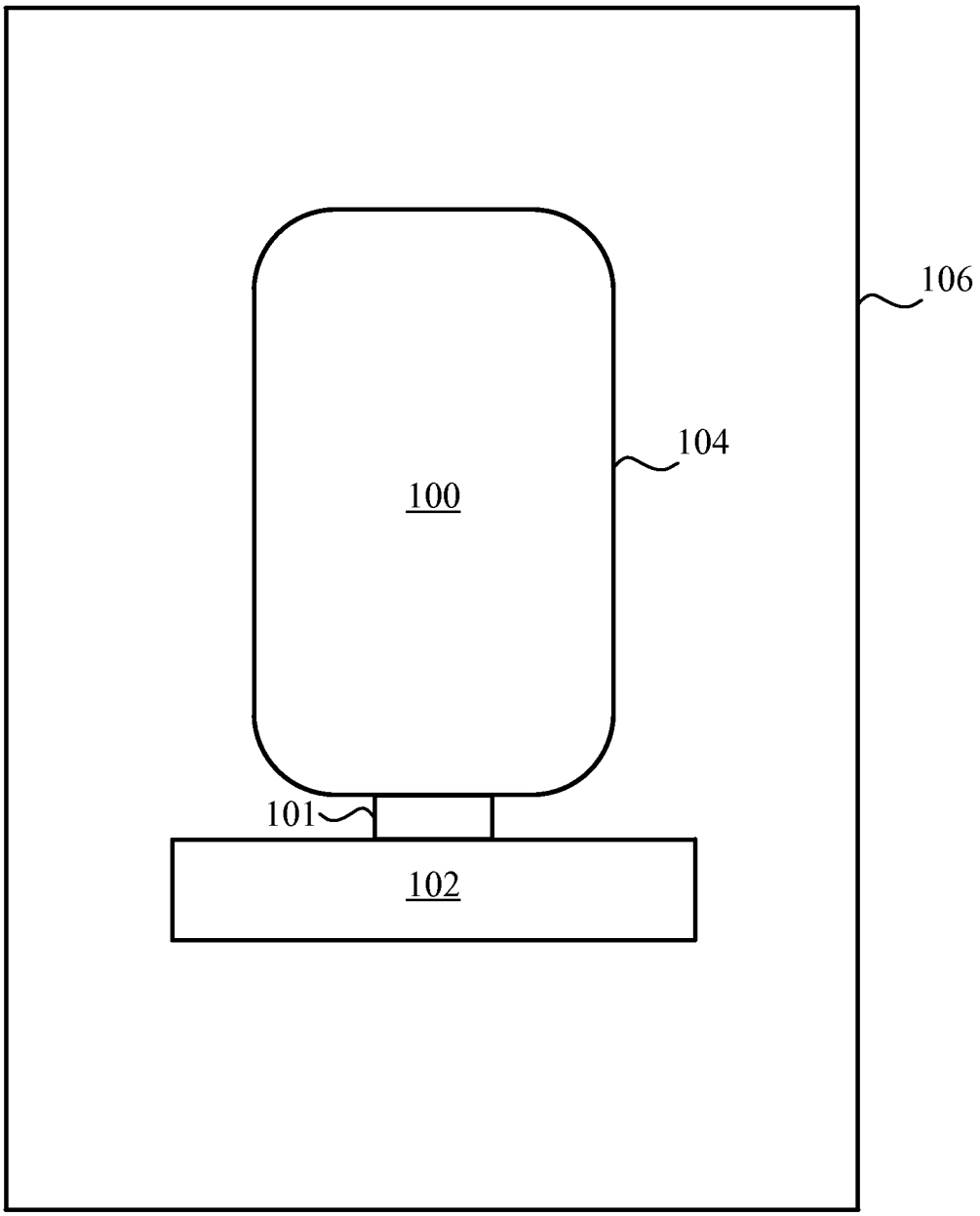

At FIG. 1B, part 100 and support 102 are placed within oven 106 in order to heat external surface 104. In some embodiments, part 100 and support 102 are place on a conveyer belt that transports part 100 and support 102 through heated areas of oven 106. Oven 106 can be any suitable type of oven or heat tunnel In some embodiments, oven 106 is a convection oven that exposes exterior surface 104 to hot air. In some embodiments, oven 106 produces steam. The hot air or steam can be directed or blown onto external surface 104 and heat up external surface 104. In some cases, the heating may be controlled locally to increase or reduce shrinking in specified areas. For example, a first portion of external surface 104 can be heated while a second portion of external surface 104 is not heated or heated to a lesser degree. Thus, the rate of shrinkage of the shrink wrap in localized areas may be controlled, which can provide for better shrinking around complex shapes or create shapes that enhance the cosmetics of the shrink wrap. To accomplish this, oven 106 can be configured such that some surface portions of external surface 104 are heated more than other surface portions. In alternative embodiments, a different type of heat source, such as a hot air gun or multiple hot air guns are used to heat external surface 104. In some cases, a heat source directly contacts external surface 104 to supply heat to external surface 104.

The temperature of oven 106 and the length of time within oven 106 can vary depending on a number of factors including the materials that make up external surface 104 and the types of materials and components, if any, within part 100. In some embodiments, care is take to make sure the temperature of external surface 104 is not so high as to destroy or damage materials that make up external surface 104. In some embodiments, the temperature tolerance of internal components, if any, within part 100 are taken into account. For example, if part 100 is a computing device with internal electronic devices, care can be taken to make sure heat-sensitive internal electronic devices are not damaged. In some cases, the internal components include adhesives, processors and plastic portions that may be temperature sensitive. In addition, external surface 104 can correspond to a painted or anodized surface that has an upper limit temperature before the painted or anodized surface is damaged (e.g., cracked or discolored). In one embodiment, oven 106 is heated to a temperature ranging from about 150 degrees C. and about 180 degrees C. In one embodiment, external surface 104 is heated to a surface temperature ranging from about 80 degrees C. and about 90 degrees C., as measured by a thermocouple. In one embodiment, part 100 is heating for a time period ranging from about 1 minute to about 5 minutes.

Figure 1C:
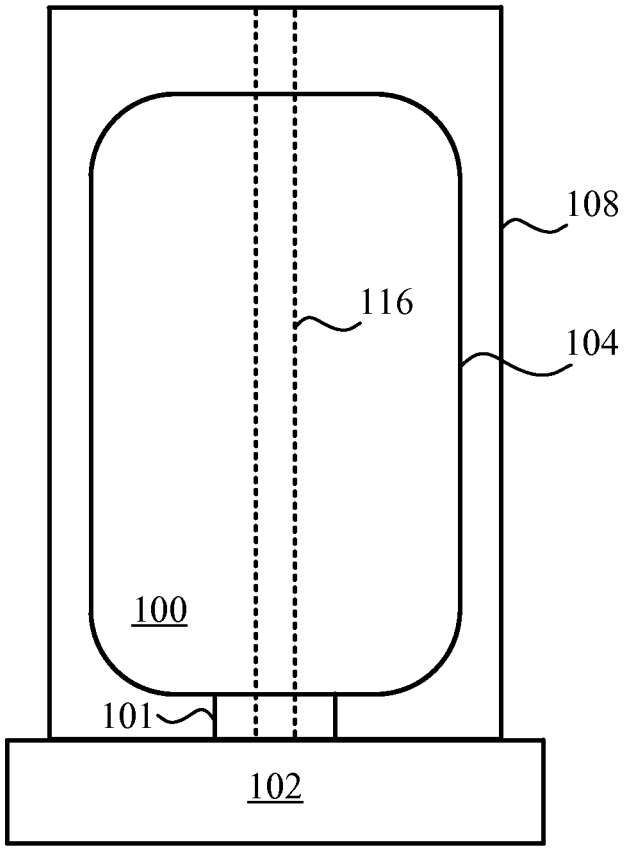

At FIG. 1C, shrink wrap film 108 is positioned around heated external surface 104 of part 100. In one embodiment, shrink wrap film 108 is tube-shaped such that it can fit over the cylindrical-shaped part 100 like a sleeve without touching heated external surface 104. In other embodiments, shrink wrap film 108 is positioned around multiple parts. Shrink wrap film 108 can have any suitable shrink wrap composition. Shrink wrap film 108 generally includes a polymer material that shrinks when heated. Shrink wrap film 108 can include a crosslinking type of polymer or a non-crosslinking type of polymer. Shrink wrap film 108 can be transparent or opaque and can be any suitable color. Shrink wrap film 108 can have any suitable thickness, strength and shrink ratio. In one embodiment, shrink wrap film 108 includes a polyethylene terephthalate (PETG) material and is substantially transparent.

In the embodiment of FIG. 1C, shrink wrap film 108 is in a pre-shrunk or elongated state prior to heating and shrinking. In an elongated state, shrink wrap film 108 has a larger surface area compared to when in a contracted state after a heating process. In an elongated state, the polymer chains of the polymer material are generally extended and stretched out. When an elongated state, such as shown in FIG. 1C, there is enough room to fit part 100 within the cavity of the tube-shaped shrink wrap film 108. In some embodiments, shrink wrap film 108 includes perforations 116, which are patterns of small holes or thinned areas within the shrink wrap material and that provide for easy removal of shrink wrap film 108 from part 100 after the shrinking process. Perforations 116 can be formed within shrink wrap film 108 prior to the shrinking process or after the shrinking process. In some embodiments, the size and location of perforations 116 are customized to provide a particular sound when torn.

Figure 1D:
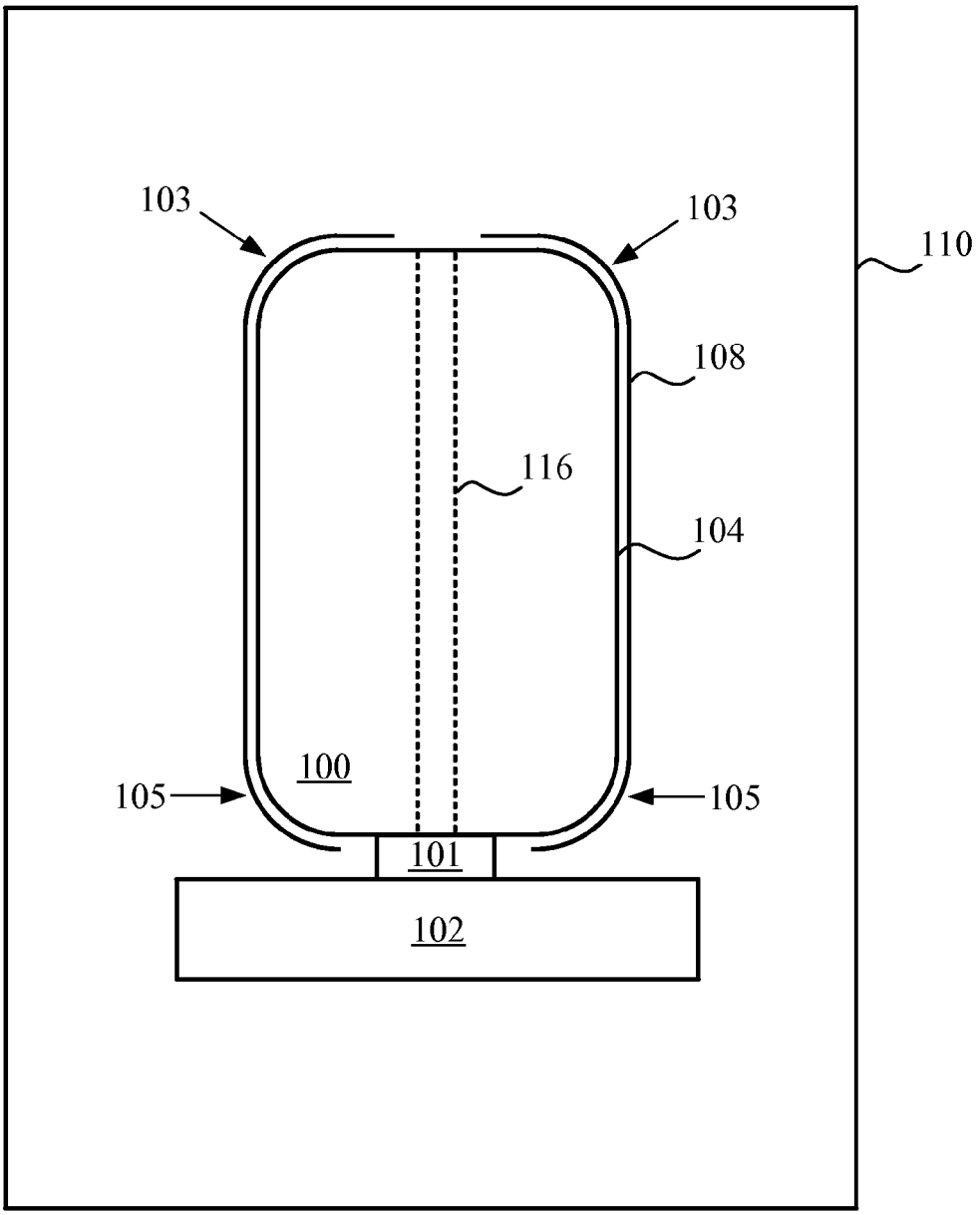

At FIG. 1D, part 100, shrink wrap film 108 and support 102 are placed within oven 110 in order to heat shrink wrap film 108. In some embodiments, part 100, shrink wrap film 108 and support 102 are place on a conveyer belt that transports part 100, shrink wrap film 108 and support 102 through heated areas of oven 110. Oven 110 can be any suitable type of oven, including an air convection oven. In some embodiments, oven 110 produces steam that can help uniformly heat shrink wrap film 108. In some embodiments, oven 110 is the same or same type of oven as oven 106. In alternative embodiments, a different type of heat source, such as a hot air gun or multiple hot air guns are used to heat shrink wrap film 108. The temperature of oven 110 and the length of time within oven 110 can vary depending on a number of factors including the type of shrink wrap film 108 that is used and the types of materials and components within part 100. In one embodiment, over 110 is heated to a temperature ranging from about 85 degrees C. and about 110 degrees C.

As shrink wrap film 108 is heated, it shrinks and contracts to a contracted state. During the shrinking, shrink wrap film 108 nears and comes into contact with heated external surface 104. Because external surface 104 is heated, there is less temperature differential between external surface 104 and the heated air/steam within oven 110. That is, an inner surface of the shrink wrap film 108 can be heated by heated external surface 104, while an outer surface of the shrink wrap film 108 can be heated by the heated air/steam within oven 110. This can result in more uniform heating and shrinking of shrink wrap film 108 compared to conventional techniques. Shrink wrap film 108 can then take on a shape that substantially matches the shape of external surface 104, creating a cosmetic fit around external surface 104. This results in shrink wrap film 108 having significantly less cosmetic defects, such as wrinkles or air pockets, than would result if external surface 104 were not heated. For example, shrink wrap film 108 formed over curved portions 103 and 105, which are prone to developing wrinkles using conventional methods, will have substantially no visible wrinkles or other cosmetic defects. Similarly, corners, edges and complex surface of a part can be uniformly covered with substantially no visible wrinkles and other defects. If multiple parts are shrink wrapped together, shrink wrap 108 will conform better to the overall shape of the multiple parts compared to using conventional methods. Note that puck 101 elevates part 100 over the top surface of support 102 such that shrink wrap film 108 can cover a portion of the bottom surface of part 100 and curved bottom portions 105.

After shrink wrap film 108 is sufficiently contracted and formed onto to external surface 108, part 110, shrink wrap 108 and support 102 can be removed from oven 110 to cool. In some embodiments, part 110, shrink wrap 108 and support 102 are cooled using an apparatus, such as a cooling tunnel. The cooling tunnel can include one or more fans that direct cooled or ambient air toward part 110, shrink wrap 108.

Figure 1E:
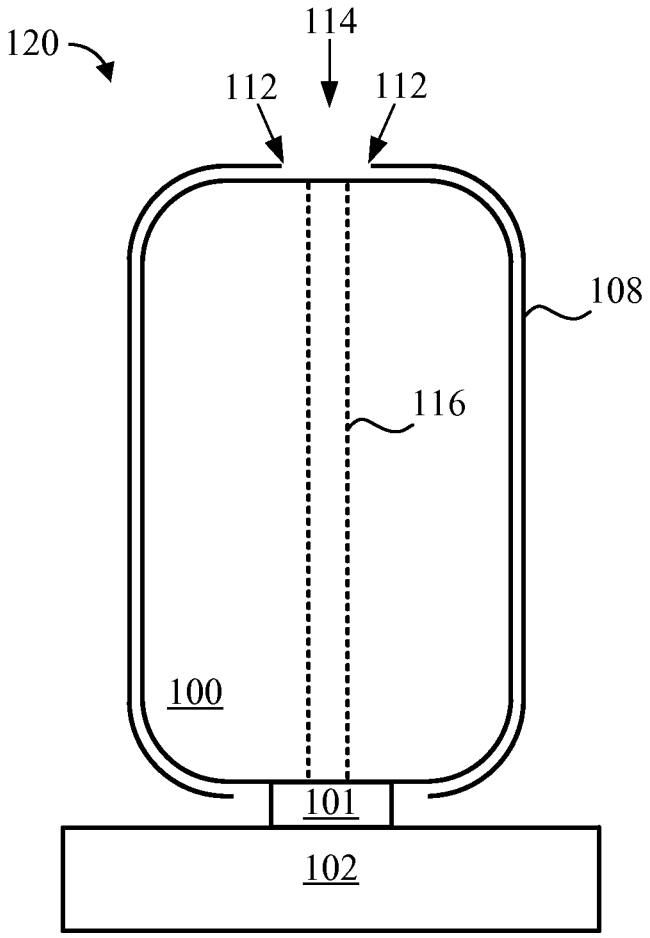
Figure 1F:
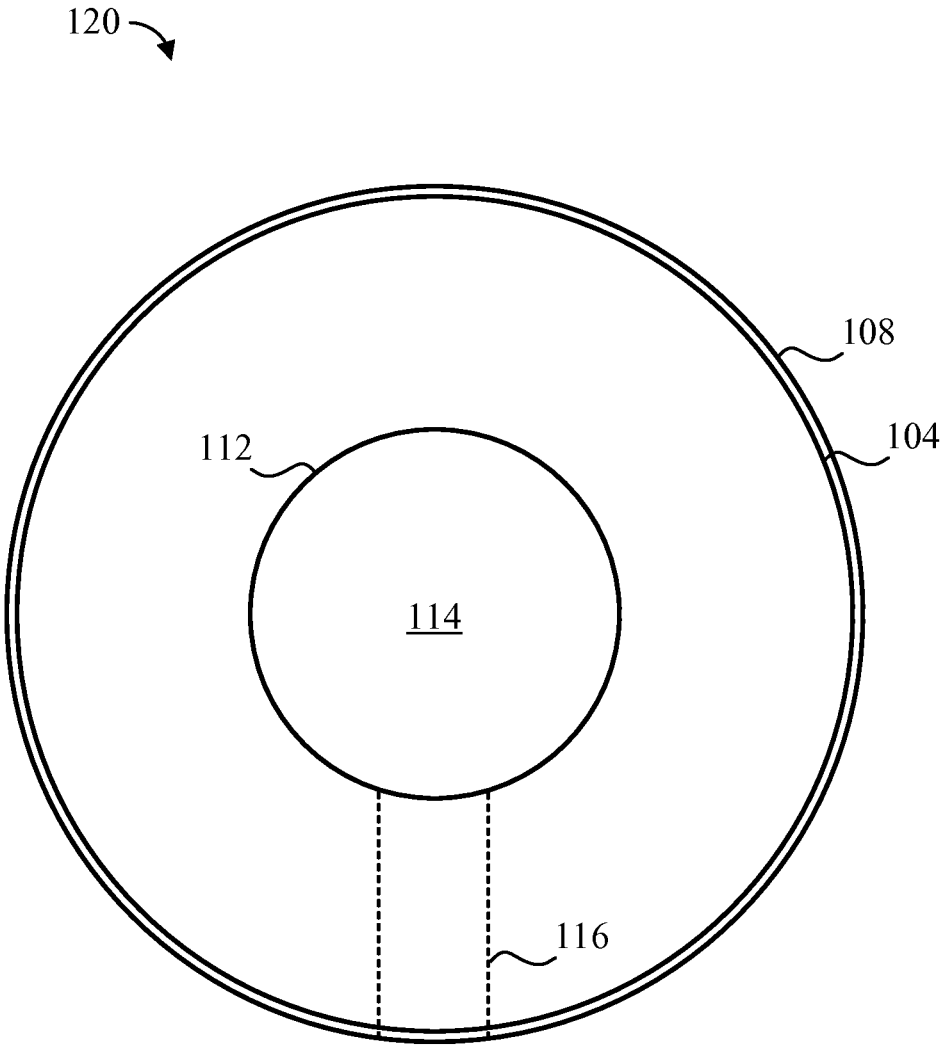

FIGS. 1E and 1F show a side view and a top-down view, respectively, of shrink wrapped part 120 after a shrink wrapping operation. As shown, shrink wrap film 108 has edge 112 that exposes part 100 at opening 114. Note that in other embodiments, shrink wrap film 108 can be configured to completely surround part 108. At this point, shrink wrapped part 120 can optionally be further processed to form features within shrink wrap film 108. These features can include tabs, further perforations or markings that can be formed using cutting, bending or marking processes.

Figure 2A:
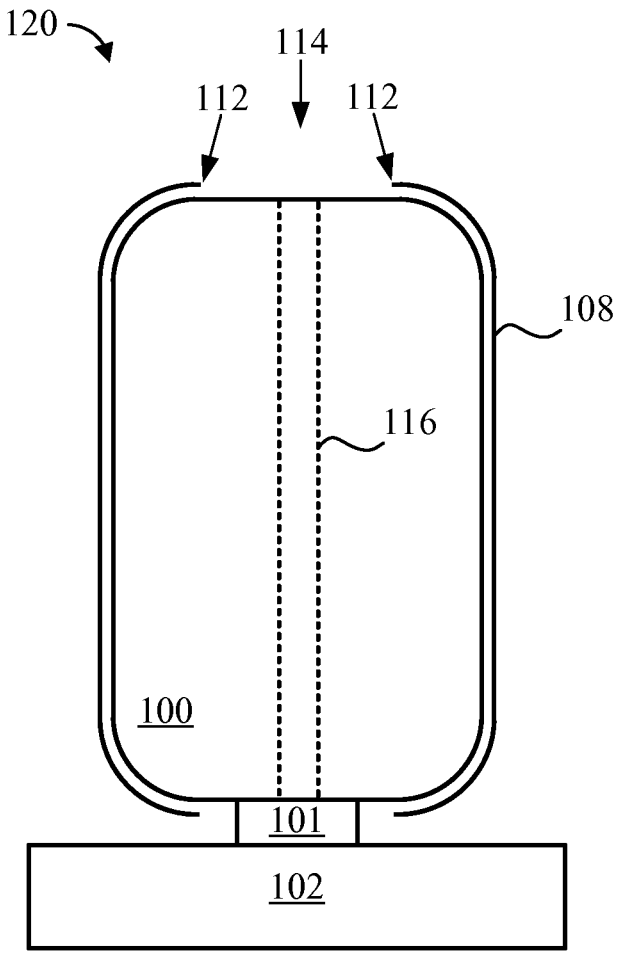
FIGS. 2A-2C show perspective views of a shrink wrapped part after undergoing a shrink wrap cutting process in accordance with some embodiments.
Figure 2B:
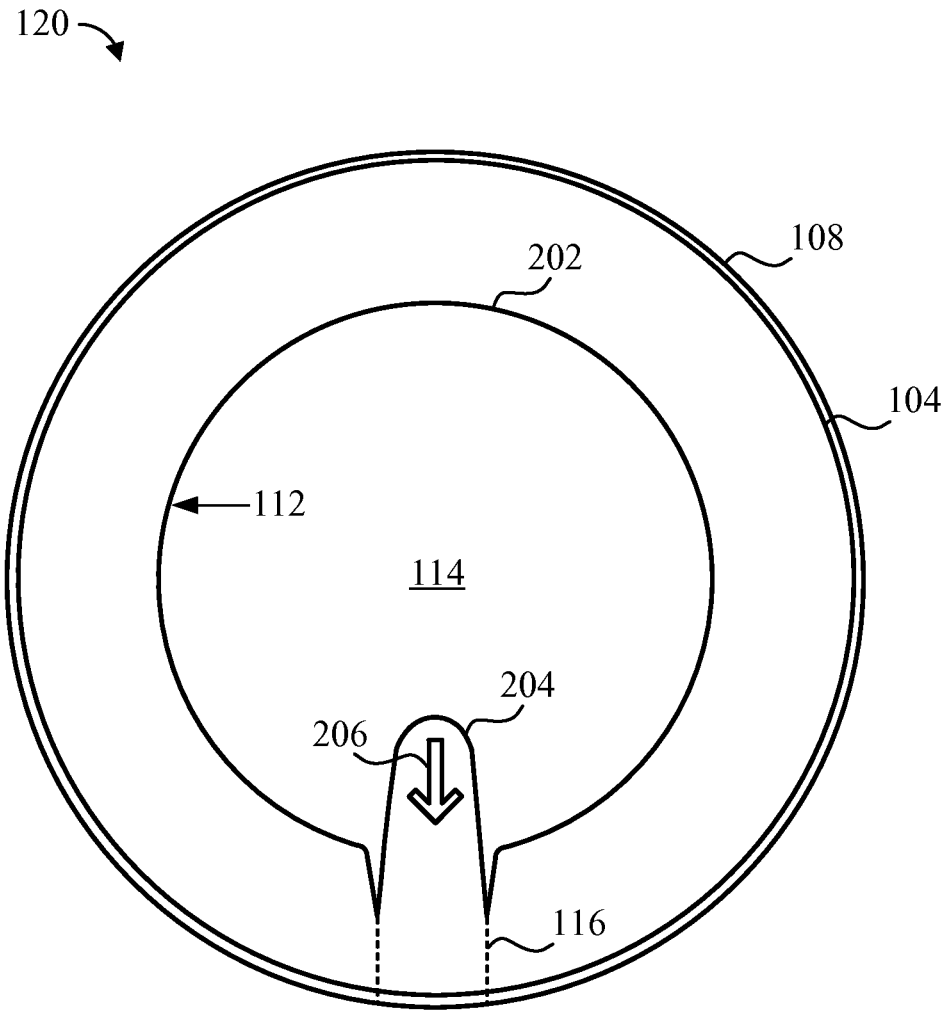

FIGS. 2A and 2B show a side view and top-down view, respectively, of shrink wrapped part 120 after a shrink wrap cutting operation. During the cutting operation, edge 112 of shrink wrap film 108 is cut to correspond to a predetermined position. In some embodiments, edge 112 is cut to align with feature 202 of part 100. Feature 202 can correspond to an edge, ridge, marking or other feature of part 100. In addition to cutting edge 112 other features, such as tab 204 and arrow 206, can be cut into shrink wrap film 108. Tab 204 is a protruding portion that extends from edge 112 that assists removal of shrink wrap film 108 from part 100. Tab 204 can be aligned with perforations 116 so that pulling down on tab 204 causes tearing of shrink wrap film 108 at perforations 116. Arrow 206 corresponds to an opening within tab 204 that indicates the direction for pulling.

In one embodiment, the cutting operation for cutting edge 112, tab 204 and arrow 206 is carried out using a laser. The laser can produce a laser beam having an energy sufficient to cut shrink wrap film 108. The laser beam focal point and relative location can be tuned in accordance with one or more reference features of part 100 or shrink wrap film 108. The reference features can be used to adjust the movement of the laser beam during the cutting. In some embodiments, an image is taken of shrink wrapped part 120 prior to the laser cutting process to identify the relative locations of the one or more reference features. In one embodiment, the reference features include feature 202, which can correspond to an edge of part 100. In one embodiment, the positions of perforations 116 are used to position the laser beam for cutting tab 204 to properly align with perforations 116.

Figure 2C:
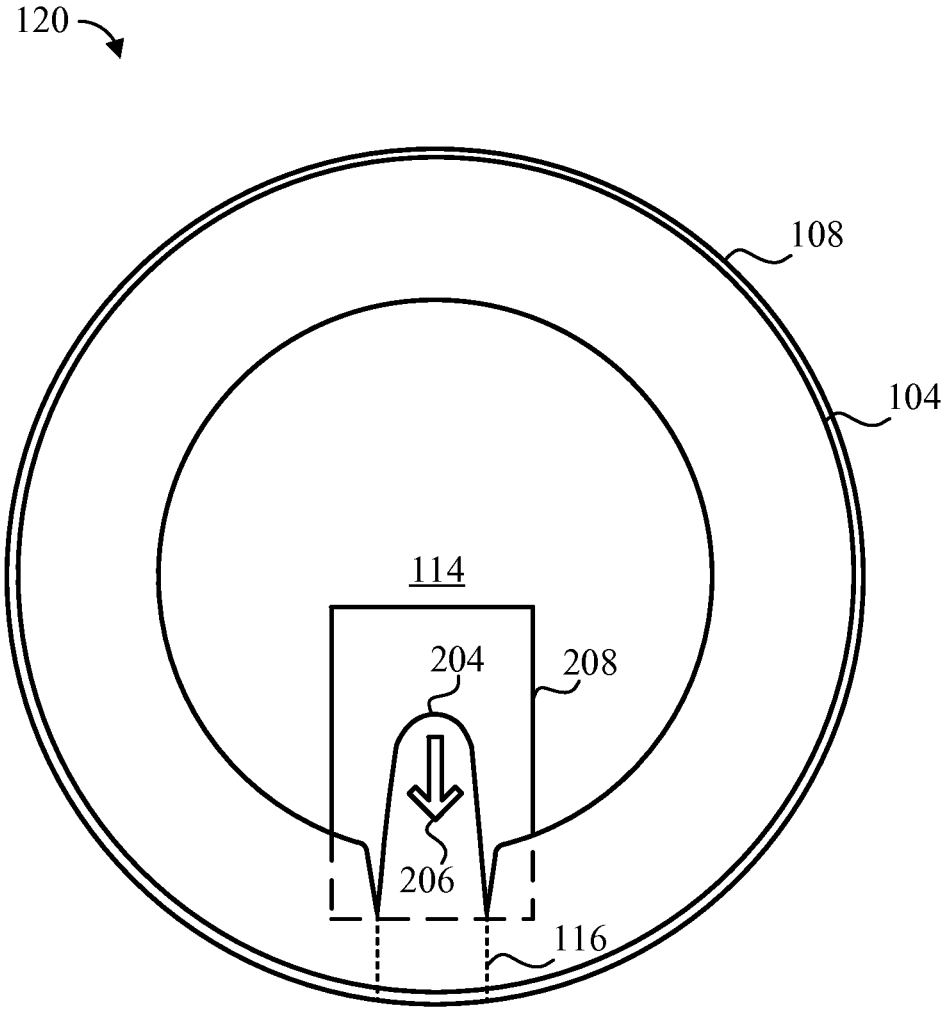

In some embodiments, one or more protective pieces are applied to shrink wrap film 108 and/or part 100 in order to protect part 100 from the laser beam. FIG. 2C shows a top-down view of shrink wrapped part 120 with protective piece 208 positioned on the underside of shrink wrap film 108, between shrink wrap film 108 and part 100, proximate to tab 204 prior to the laser cutting operation. Protective piece 208 can be made of any suitable material, such as a suitable plastic film or sheet. In some embodiments, protective piece 208 is removed from shrink wrapped part 120 after the laser cutting process. In some embodiments, protective piece 208 is applied to shrink wrap film 108 with an adhesive that binds to a removable portion of shrink wrap film 108. When protective piece 208 is removed, the removable portion of the shrink wrap film 108 is simultaneously removed. In one embodiment, the removable portion of the shrink wrap film 108 corresponds to an indicia-shaped opening, e.g., arrow 206. That is, when protective piece 208 is removed, the internal shrink wrap material portion corresponding to arrow 206 is removed from tab 204, leaving an opening at arrow 206. In this way, protective piece 208 can serve two purposes: protecting part 100 during the laser cutting process and assisting removal of a removable portion of shrink wrap film 108. After the cutting process is complete, shrink wrapped part 120 can be further processed or can be packaged (e.g., boxed).

Figure 3:
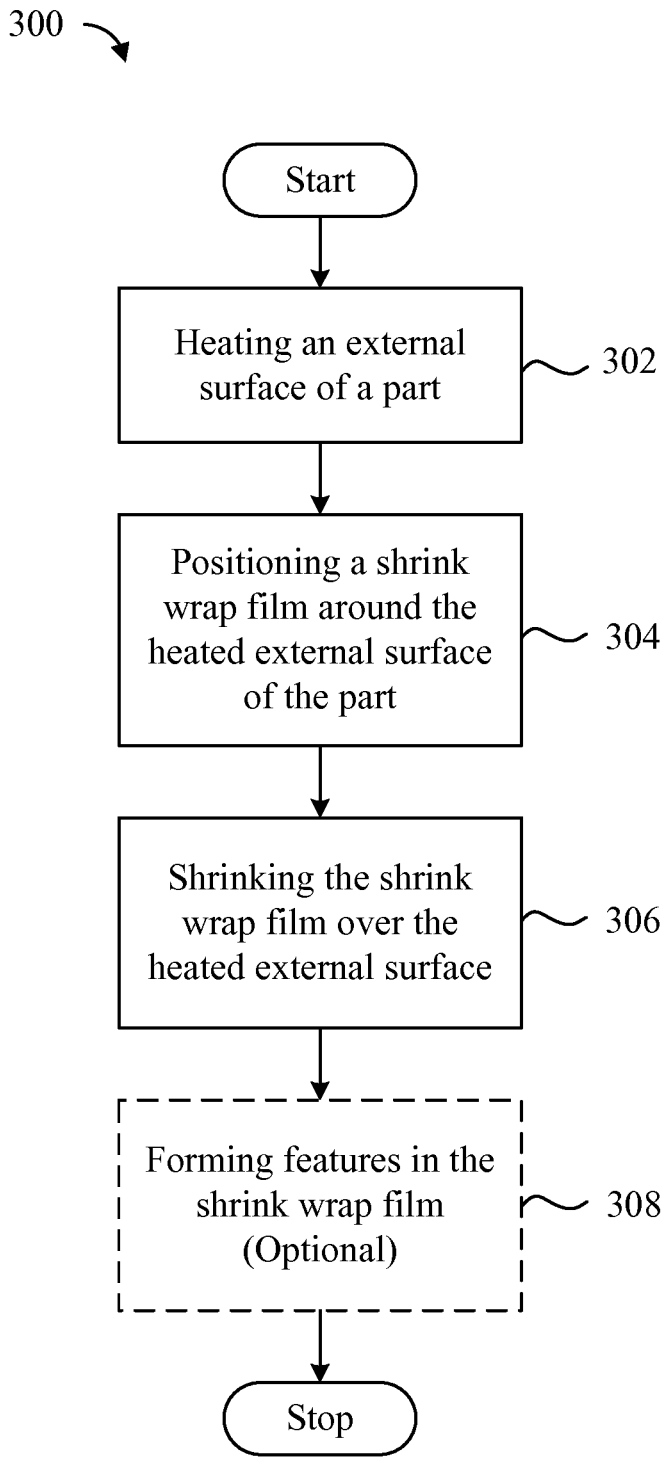
FIG. 3 shows a high-level flowchart indicating a shrink wrapping process in accordance with described embodiments.

FIG. 3 shows high-level flowchart 300 indicating a shrink wrapping process in accordance with described embodiments. At 302, an external surface of a part is heated. In some embodiments, the external surface is cleaned prior to heating in order to remove materials such as lubricants or residues. The external surface can correspond to, for example, a housing for an electronic device. The housing can be fully assembled with internal components during the heating or can be partially assembled or empty. The external surface can correspond to the surfaces of one or more metallic, plastic (e.g., polycarbonate), ceramic or glass materials. In one embodiment, the external surface corresponds to aluminum (aluminum or aluminum alloy) and/or stainless steel surfaces. The temperature and duration at which the external surface is heated can depend on a number of factors including the type of material(s) that correspond to the external surface and the temperature tolerance of the internal components. For example, the internal components can include electronic components (e.g., microprocessors), adhesives or plastic components, which are heat sensitive. In addition, the external surfaces can include paints, inks or films (e.g. oxide films) that can crack, discolor or otherwise detrimentally react to high temperatures. In a production environment, the part is typically placed on a conveyor that transfers the part through an oven in order to heat the external surfaces. In some embodiments, the part is place on a support that can support the part during one or more processes 302, 304, 306 and 308.

At 304, a shrink wrap film is positioned around or on the heated external surface of the part. In some embodiments, the time period between heating at 302 and positioning of the shrink wrap film at 304 is minimized so that the external surface does not cool too much. The shrink wrap film is in an elongated state or pre-shrunk state prior to heat shrinking process. The shrink wrap film can be position proximate to the heated external surface but not in contact with the heated external surface. The shrink wrap film can be made of any suitable shrink wrap material. The shrink wrap film can be pre-cut to have a predetermined size. In some embodiments, the shrink wrap film has features, such as precut perforations. The shrink wrap film can positioned around or over the heated external surface by a person or a robot.

At 306 the shrink wrap film is shrunken into a contracted state over the heated external surface. In some embodiments, an external heat source is applied to the shrink wrap film. The external heat source can be an oven, such as the oven used to heat the external surface in 302. The temperature and duration at which the shrink wrap film is exposed can vary depending on a number of factors including the type of shrink wrap film and the materials and internal component of the part, as described above. As the shrink wrap film contracts, the heated external surface of the part comes into contact with the shrink wrap film causing the shrink wrap film to conform to the shape of the external surface. The resultant contracted shrink wrap film can have a shape that substantially matches the shape of the external surface without substantially any wrinkles, bulges or other visible defects. This can include portions of the external surface that are difficult to shrink wrap without causing wrinkles using conventional shrink wrapping techniques. For example, the shrink wrap film can conform to curved surfaces, edges and corners without substantially any visible defects within the shrink wrap film. In some embodiments, the temperature difference between the heated external surface and the heated shrink wrap film is minimized in order to produce optimal results.

At 308, features are optionally formed in the shrink wrap film. In one embodiment, a laser may be used to cut the features within the shrink wrap film. The laser can be used to cut openings, create shapes or clean up edges of the shrink wrap film. In one example, the electronic device includes an open area over which a portion of the shrink wrap is placed, and a laser is used to cut an opening in the shrink wrap around the open area proximate an edge of the electronic device. In another example, the laser is used to form a pull tab. In another embodiment, the laser is used to create indicia in the shrink wrap film by creating shaped openings or localized heating of the shrink wrap surface. The laser cutting process can include directing a laser beam at the shrink wrap film. In some embodiments, the laser beam is tuned to have an energy sufficient to cut the shrink wrap film. In other embodiments, the laser beam is tuned to melt or deform the shrink wrap film. In some embodiments, one or more protective pieces are used to cover portions of the part during the laser cutting procedure. The laser beam can be programed to cut the shrink wrap film at locations corresponding to one or more reference features of the part or shrink wrap film. After 308, the shrink wrapped part can be inspected for wrinkles and other defects. In one embodiment, the shrink wrapped part is visually inspected at a predetermined distance at all angles. The resultant shrink wrapped part will be cosmetically appealing and provide an enhanced consumer experience.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A method of shrink wrapping a part, the method comprising:

heating an external surface of the part, the external surface having a shape;

positioning a shrink wrap film while in an elongate state around the heated external surface; and shrinking the shrink wrap film over the external surface of the part, wherein during the shrinking the shrink wrap film contacts the heated external surface of the part causing the shrink wrap film to take on a contracted state having a shape that matches the shape of the external surface.

2. The method of claim 1, wherein shrinking the shrink wrap comprises heating the shrink wrap using an external heat source.

3. The method of claim 2, wherein the heat source is heated air produced by one or more of an oven and hot air gun.

4. The method of claim 1, wherein heating the external surface of the part includes processing the part in an oven.

5. The method of claim 1, wherein the part is an electronic device, wherein heating the external surface of the part includes heating a housing of the electronic device.

6. The method of claim 1, wherein the external surface of the part includes a metallic surface.

7. The method of claim 6, wherein the metallic surface is anodized or painted.

8. The method of claim 1, wherein the external surface of the part includes a curved surface, wherein the shrink wrap film uniformly conforms to the curved surface.

9. A method of shrink wrapping a part, the method comprising:

heating an external surface of the part;

positioning a shrink wrap film around the external surface of the part such that an inner surface of the shrink wrap is proximate the heated external surface of the part; and heating an outer surface of the shrink wrap film such that the shrink wrap film shrinks and conforms to the external surface of the part, wherein during the shrinking the heated external surface of the part heats the inner surface of the shrink wrap causing uniform heating and shrinking of the shrink wrap film around the external surface of the part.

10. The method of claim 9, wherein the part is an electronic device, wherein heating the external surface of the part includes heating a housing of the electronic device.

11. The method of claim 9, wherein the external surface of the part is a metallic surface.

12. The method of claim 9, wherein heating the outer surface of the shrink wrap film includes directing heat from a heat source to the outer surface of the shrink wrap film.

13. The method of claim 12, wherein heat source is a heat tunnel.

14. The method of claim 9, further comprising:

cutting features within the shrink wrap film using a laser, the features configured to assist subsequent removal of the shrink wrap film from the part.

15. A method of shrink wrapping an electronic device, the method comprising:

heating an external surface of the electronic device;

positioning a shrink wrap film around the heated external surface of the electronic device; and shrinking the shrink wrap film by heating the shrink wrap film to a temperature sufficient for the shrink wrap film to conform to the external surface of the electronic device, wherein heating the external surface causes the shrink wrap to uniformly conform to the external surface of the electronic device.

16. The method of claim 15, wherein the external surface of the electronic device corresponds to a housing of the electronic device.

17. The method of claim 16, wherein the housing is heated to a temperature high enough to heat the inner surface of the shrink wrap and low enough not to substantially damage internal components of the electronic device.

18. The method of claim 15, wherein heating the external surface of the electronic device includes heating the external surface to at least a predetermined temperature.

19. The method of claim 15, wherein the shrink wrap film uniformly conforms to the external surface of the electronic device without forming visible wrinkles in the shrink wrap film.

20. The method of claim 15, wherein the external surface includes a curved bottom surface, the method further comprising:

prior to heating the external surface, placing the electronic device on a support structure that supports the electronic device while exposing the curved bottom surface during the heating.

* * * * *